US008359667B2

(12) United States Patent
Clark

(10) Patent No.: US 8,359,667 B2
(45) Date of Patent: Jan. 29, 2013

(54) ATHLETIC GLOVE WITH ENHANCED TENSIONING

(76) Inventor: Timothy A. Clark, Durham, OR (US)

( * ) Notice: Subject to any disclaimer, the term of this patent is extended or adjusted under 35 U.S.C. 154(b) by 213 days.

(21) Appl. No.: 12/849,559

(22) Filed: Aug. 3, 2010

(65) Prior Publication Data

US 2012/0030855 A1 Feb. 9, 2012

(51) Int. Cl.
*A41D 19/00* (2006.01)

(52) U.S. Cl. ..... 2/161.1; 2/161.4; 2/159

(58) Field of Classification Search ..... 2/159, 161.1–161.8, 162
See application file for complete search history.

(56) References Cited

U.S. PATENT DOCUMENTS

| | | | | |
|---|---|---|---|---|
| 3,952,333 | A * | 4/1976 | Fujita | 2/161.5 |
| 4,040,126 | A * | 8/1977 | Cecil | 2/161.5 |
| 4,877,242 | A * | 10/1989 | James | 473/46 |
| 4,962,547 | A * | 10/1990 | Minnick | 2/161.4 |
| D340,793 | S * | 11/1993 | Autier | D29/116.2 |
| 5,309,573 | A * | 5/1994 | Solar et al. | 2/160 |
| 5,444,874 | A * | 8/1995 | Samelian et al. | 2/159 |
| 5,664,260 | A * | 9/1997 | Weiser | 2/159 |
| 5,740,555 | A * | 4/1998 | Renegar | 2/161.2 |
| 5,774,895 | A * | 7/1998 | Baldwin | 2/161.1 |
| 6,010,473 | A * | 1/2000 | Robinson | 602/21 |
| 6,415,445 | B1 * | 7/2002 | Nishijima et al. | 2/161.4 |
| 6,427,247 | B1 * | 8/2002 | Suk | 2/161.2 |
| 6,728,971 | B1 * | 5/2004 | Benavidez | 2/161.4 |
| 2003/0005506 | A1 * | 1/2003 | Litke | 2/161.2 |
| 2006/0150356 | A1 * | 7/2006 | Tayler et al. | 15/227 |
| 2006/0230493 | A1 * | 10/2006 | Corry et al. | 2/159 |
| 2007/0067891 | A1 * | 3/2007 | Schauffele et al. | 2/161.1 |
| 2007/0118966 | A1 * | 5/2007 | Beraznik | 2/159 |
| 2007/0174948 | A1 * | 8/2007 | Robba et al. | 2/161.1 |
| 2007/0226872 | A1 * | 10/2007 | Huh | 2/159 |
| 2007/0226873 | A1 * | 10/2007 | Mattesky | 2/159 |
| 2008/0201822 | A1 * | 8/2008 | Oshima et al. | 2/161.3 |
| 2008/0276348 | A1 * | 11/2008 | England et al. | 2/161.2 |
| 2009/0038052 | A1 * | 2/2009 | Gellis | 2/161.8 |
| 2009/0100573 | A1 * | 4/2009 | Coulter et al. | 2/161.1 |

* cited by examiner

*Primary Examiner* — Khoa Huynh
*Assistant Examiner* — Andrew W Collins
(74) *Attorney, Agent, or Firm* — Shook, Hardy & Bacon L.L.P.

(57) ABSTRACT

An athletic glove with enhanced tensioning is provided. The glove comprises a palm-side portion and a back portion connected to form four finger sheaths, a thumb sheath, and an opening capable of receiving a human hand. A keyhole cutout is located along the opening at a location corresponding to the back of a user's hand. A tension-adjusting wrist strap is attached to the glove on a first side of the keyhole adjacent to the opening. The wrist strap extends across the keyhole and is detachably affixable to a second side of the keyhole adjacent to the opening. The wrist strap may be used to adjust the tension across the palm-side portion by adjusting where the strap is detachably affixed. The wrist strap connects to the palm-side portion at an angle to optimize the distribution of tensioning force to reduce bunching in the palm-side portion and provide enhanced gripping.

19 Claims, 5 Drawing Sheets

ATHLETIC GLOVE WITH ENHANCED TENSIONING

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention relates to athletic gloves. More particularly, the present invention relates to an athletic glove that provides an enhanced gripping experience by reducing bunching of the glove through a novel tensioning system.

BACKGROUND

Both professional and amateur athletes often wear athletic gloves to enhance gripping. In football, for example, wide receivers, tight ends, running backs, and others whose performance depends upon the ability to effectively grip the football often wear gloves to enhance their grip on the football. Conventional athletic gloves are typically designed with a tensioning strap that extends across a keyhole cutout located along the side of the glove near the wrist of a user when the glove is worn. The tensioning strap is typically attached to the edge of the glove near and perpendicular to the keyhole. When such a tensioning strap is tightened, tensioning force is only distributed to the portion of the glove immediately adjacent to the keyhole, and the tensioning force is applied almost entirely along the direction of the wrist. Bunching of the palm portion of the glove can occur as a result.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Embodiments of the present invention relate to an athletic glove with enhanced tensioning across the palm. The glove comprises a back portion and a palm-side portion. The palm-side portion is connected to the back portion to form four finger sheaths, a thumb sheath, and an opening capable of receiving a human hand. The opening is located opposite the four finger sheaths and corresponds approximately to the wrist of a user when the glove is worn by the user with fingers of the user extending within the four finger sheaths and the thumb of the user extending within the thumb sheath. A keyhole cutout is located along the opening at a location corresponding to the back of a user's hand. A tension-adjusting wrist strap is attached to the glove on a first side of the keyhole adjacent to the opening. The wrist strap extends across the keyhole to a second side of the keyhole and is detachably affixable to the second side of the keyhole adjacent to the opening.

The wrist strap comprises a base portion attached to the glove on the first side adjacent to the keyhole. The base portion extends away from the keyhole along the opening to a location along the opening that corresponds to the palm side of the user's wrist. The wrist strap also comprises a tab portion extending from the base portion across the keyhole. The tab portion is detachably affixable to the glove on the second side along the opening such that when the tab portion of the wrist strap is detachably affixed, the tab portion lays across the keyhole. The wrist strap may be used to adjust the tension across the palm-side portion of the glove by adjusting where the tab portion is detachably affixed.

BRIEF DESCRIPTION OF THE DRAWINGS

The present invention is described in detail below with reference to the attached drawing figures, wherein.

DETAILED DESCRIPTION

As discussed above, in conventional athletic gloves, the keyhole associated with the tensioning strap is located along the seam between the palm-side and back portions on the side of the glove, and the tensioning strap typically attaches to the edge of the glove adjacent and perpendicular to the keyhole. When such a tensioning strap is tightened, tensioning force is only distributed to the portion of the glove immediately adjacent to the keyhole, and the tensioning force is applied almost entirely along the direction of the wrist. Bunching of the palm portion of the glove can occur as a result.

Figure 1:
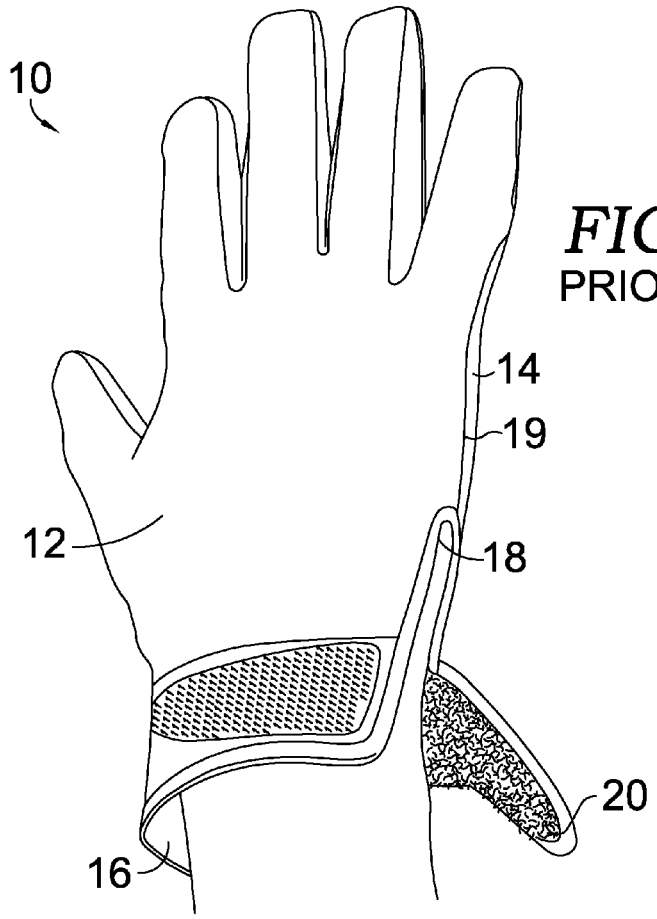
FIG. 1. PRIOR ART
FIG. 1 is a perspective view of a prior art athletic glove with tensioning strap illustrating the back portion of the glove with the wrist strap unaffixed.

FIG. 1 illustrates a prior art conventional athletic glove 10. Glove 10 comprises a back portion 12 and a palm-side portion 14 (partially visible). Palm-side portion 14 and back portion 12 are connected to form four finger sheaths, a thumb sheath, and an opening 16 capable of receiving a human hand. Keyhole cutout 18 is located along the seam 19 where back portion 12 and palm-side portion 14 are connected. This location corresponds to the side of a user's hand when glove 10 is worn by the user. Keyhole 18 is also located along opening 16. Wrist strap 20 is attached along opening 16 adjacent to keyhole 18, as shown more clearly in FIG. 2. When the fit of glove 10 is tightened using wrist strap 20, wrist strap 20 extends across keyhole 18 and affixes to glove 10. Wrist strap 20 is shown affixed in FIG. 2.

Figure 2:
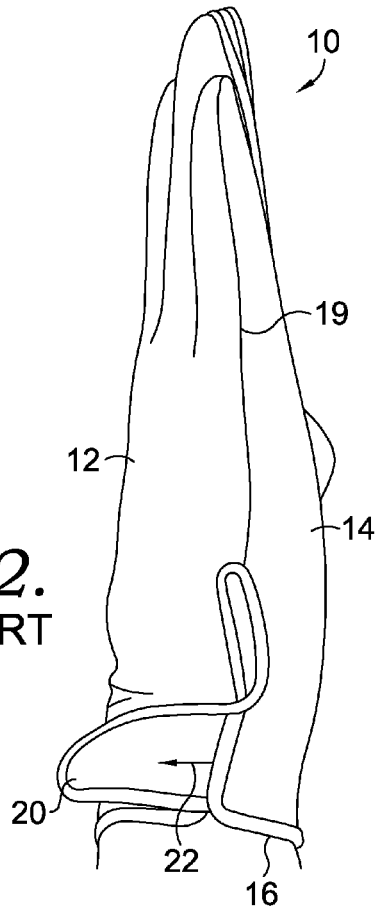
FIG. 2. PRIOR ART
FIG. 2 is a perspective view of a prior art athletic glove with tensioning strap illustrating the side of the glove with the wrist strap affixed.

With reference now to FIG. 2, prior art conventional athletic glove 10 is shown from a side view. Wrist strap 20 is attached perpendicularly to palm-side portion 14. Palm-side portion 14 extends substantially straight down from seam 19. In this configuration, when a tensioning force is applied to wrist strap 20, the tensioning force is applied almost entirely along force vector 22. This tensioning force acts to tighten primarily the area of palm-side portion 14 along opening 16 and can result in bunching in the remainder of palm-side portion 14.

Figure 3:
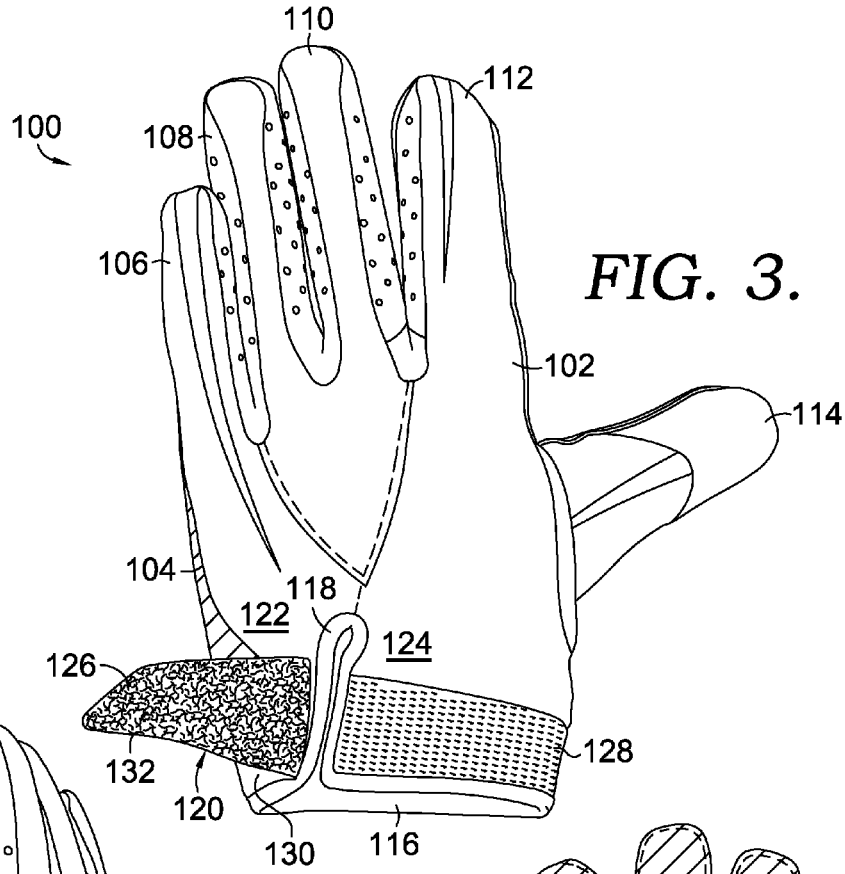
FIG. 3 is a perspective view of an exemplary embodiment of an athletic glove with enhanced tensioning illustrating the back portion of the glove with the wrist strap unaffixed.

Referring now to FIG. 3, an athletic glove 100 capable of receiving a human hand is shown. Glove 100 comprises a back portion 102 and a palm-side portion 104 (partially visible). Palm-side portion 104 is more clearly illustrated in FIG. 4. Palm-side portion 104 and back portion 102 are connected to form four finger sheaths 106, 108, 110, and 112, a thumb sheath 114, and an opening 116 capable of receiving a human hand. Opening 116 is located opposite finger sheaths 106, 108, 110, and 112 and corresponds approximately to the wrist of a user when the glove is worn by the user with fingers of the user extending within finger sheaths 106, 108, 110, and 112 and the thumb of the user extending within thumb sheath 114. Back portion 102 corresponds to the back of the user's hand, and palm-side portion 104 corresponds to the palm of the user's hand. Gussets or other additional pieces of material may bridge between back portion 102 and palm-side portion 104 to form glove 100.

Keyhole cutout 118 is located along opening 116. Keyhole cutout 118 extends from opening 116 inwards toward finger sheaths 106, 108, 110, and 112. In some embodiments, keyhole 118 is between approximately one-half and two inches in length as measured from opening 116 to the furthest extent of keyhole 118. The location of keyhole 118 along opening 116 corresponds to the back of the user's hand. In some embodiments, keyhole 118 is located closer to the center of the back of a user's hand than to either side. In other embodiments, keyhole 118 is located closer to either side than to the center of the back of a user's hand.

Tension-adjusting wrist strap 120 is attached to glove 100 on a first side 122 of keyhole 118 adjacent to opening 116. Wrist strap 120 is detachably affixable to a second side 124 of keyhole 118 adjacent to opening 116. In FIG. 3, wrist strap 120 is detachably affixable with hook-and-loop connectors, with wrist strap 120 having loop material 126 and back portion 102 of glove 100 having hook material 128. In other embodiments, wrist strap 120 is detachably affixable to second side 124 with snaps. Additional means of detachably affixing wrist strap 120 to second side 124 are contemplated, including buttons, hooks, clasps, adhesive, and instant bonding compounds. In some embodiments, wrist strap 120 is detachably affixable in a plurality of positions.

Figure 4:
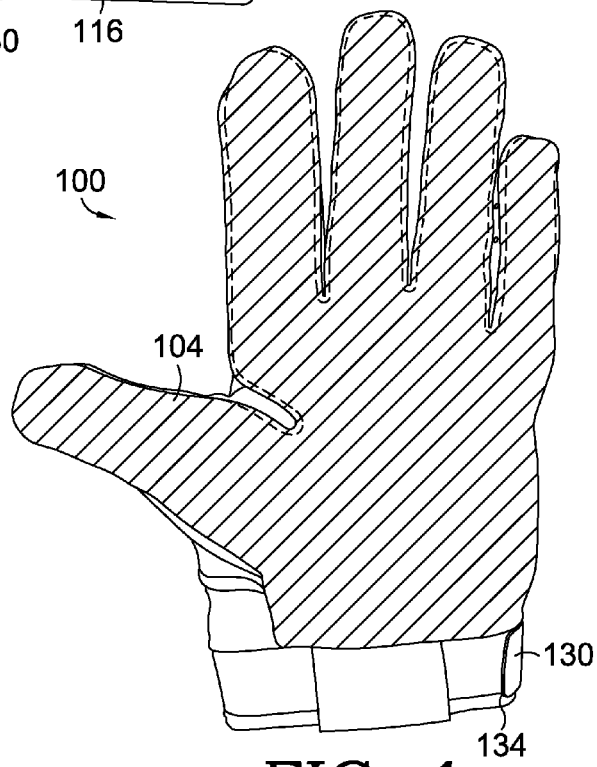
FIG. 4 is a perspective view of an exemplary embodiment of an athletic glove with enhanced tensioning illustrating the palm-side portion of the glove.

Wrist strap 120 comprises base portion 130 and tab portion 132. Base portion 130 is attached to glove 100 on first side 122. Base portion 130 extends away from keyhole 118 along opening 116 to a location that corresponds to the palm side of the user's wrist, as shown in FIG. 4. FIG. 4 illustrates palm-side portion 104 of glove 100. In some embodiments, palm-side portion 104 is made of a grip-enhancing material such as rubber, synthetic leather, textured material, or other material. The extent of base portion 130 of wrist strap 120 is shown as location 134. Location 134 corresponds to the palm-side of a user's wrist when glove 100 is worn by a user as described above with regard to FIG. 3. In some embodiments, base portion 130 extends farther along opening 116 such that location 134 is closer to the center of palm-side portion 104 than shown in FIG. 4.

Figure 5:
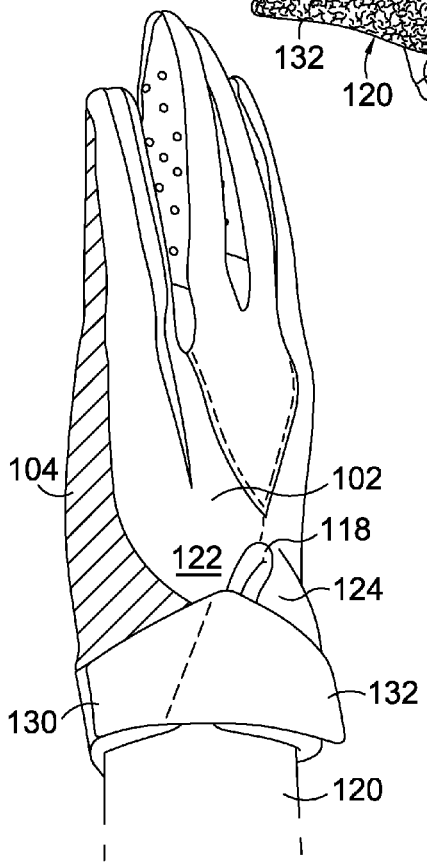
FIG. 5 is a perspective view of an exemplary embodiment of an athletic glove with enhanced tensioning illustrating the side of the glove with the wrist strap affixed.

Base portion 130 and tab portion 132 of wrist strap 120 are shown in greater detail in FIG. 5. FIG. 5 shows a side view of glove 100 worn by a user. Tab portion 132 of wrist strap 120 is detachably affixed to second side 124 of keyhole 118. When wrist strap 120 is detachably affixed, tab portion 132 lays across keyhole 118. The tension across palm-side portion 104 is increased or decreased by adjusting where tab portion 132 detachably affixes to second side 124. Adjusting the affixation point from closer to keyhole 118 to farther from keyhole 118 increases the tension on palm-side portion 104, while adjusting the affixation point from farther from keyhole 118 to closer to keyhole 118 decreases the tension on palm-side portion 104. In some embodiments, wrist strap 120, comprising both base portion 130 and tab portion 132, is one continuous piece of material.

In FIG. 5, palm-side portion 104 flares out as it approaches keyhole 118 and base portion 130. Base portion 130 is attached to palm-side portion 104. The connection between base portion 130 and palm-side portion 104 forms an angle relative to a cross section of the user's wrist, as further illustrated in FIG. 6.

Figure 6:
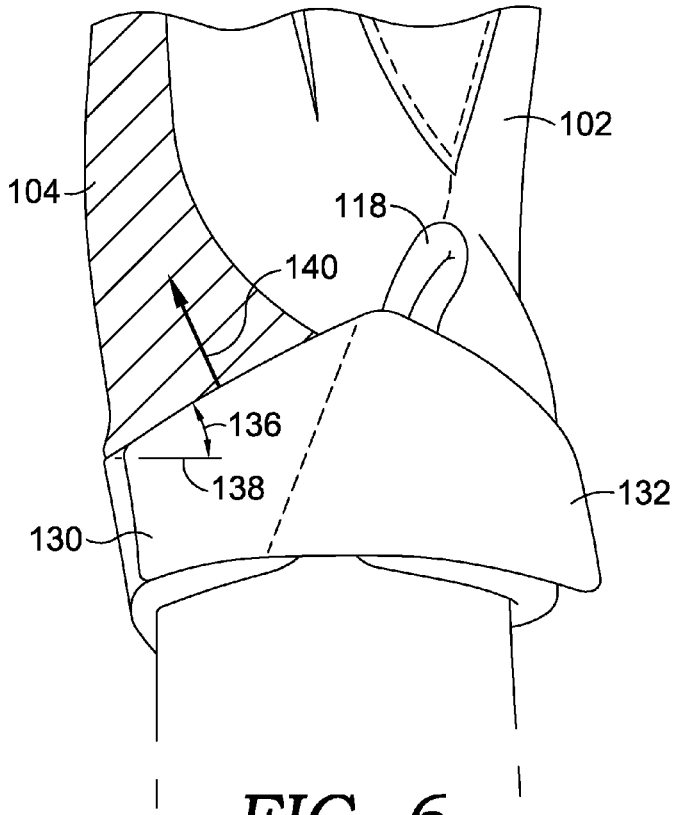
FIG. 6 is a partial perspective view of an exemplary embodiment of an athletic glove with enhanced tensioning illustrating the direction of force applied when the tensioning strap is tightened.

FIG. 6 shows a partial perspective view of glove 100. Palm-side portion 104 is connected to base portion 130 at an angle 136 relative to a cross section 138 of the user's wrist. In some embodiments, angle 136 measures between 10 and 80 degrees. Connecting palm-side portion 104 to base portion 130 at an angle allows tensioning force to be applied along force vector 140 toward palm-side portion 104 rather than simply in the direction of cross-section 138 as occurs in athletic gloves with conventional tensioning systems, such as prior art glove 10 of FIGS. 1-2. Application of force along force vector 140 reduces bunching that occurs in palm-side portion 104 by applying tensioning force to a greater area of palm-side portion 104 as compared to the area of palm-side portion 14 in FIG. 2 that receives tensioning force upon application of force vector 22. Flaring of palm-side portion 104 further aids in optimal distribution of tensioning force toward palm-side portion 104 by providing a greater length of connection between base portion 130 and palm-side portion 104. In contrast, palm-side portion 14 of conventional prior art glove 10 in FIGS. 1-2 does not flare and only receives tensioning force perpendicularly over a small area along opening 16. In some embodiments, palm-side portion 104 extends to keyhole 118, as shown in FIG. 7.

Figure 7:
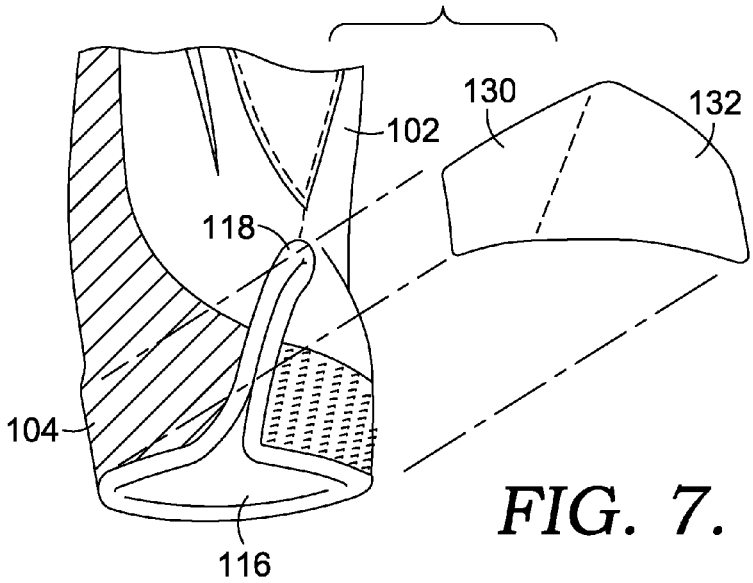
FIG. 7 is an exploded partial perspective view of an exemplary embodiment of an athletic glove with enhanced tensioning illustrating the extent of the palm-side portion of the glove.

FIG. 7 is an exploded partial perspective view of palm-side portion 104 and back portion 102 around keyhole 118. Palm-side portion 104 extends to keyhole 118. Base portion 130 is attached at least in part to palm-side portion 104. In some embodiments, palm-side portion 104 extends only to the edge of base portion 130. In other embodiments, palm-side portion 104 extends part way between the edge of base portion 130 and keyhole 118.

Figure 8:
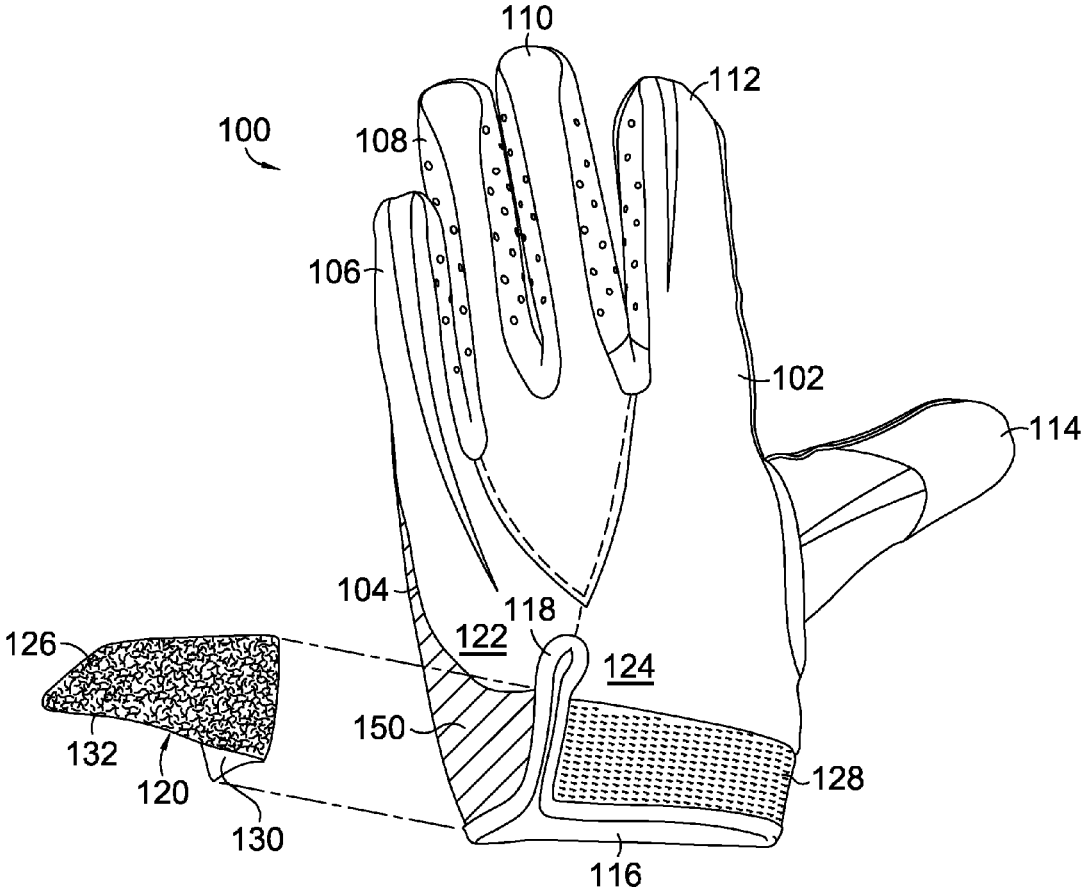
FIG. 8 is an exploded perspective view of an exemplary embodiment of an athletic glove with enhanced tensioning illustrating the back portion of the glove with the wrist strap unaffixed.
Figure 9:
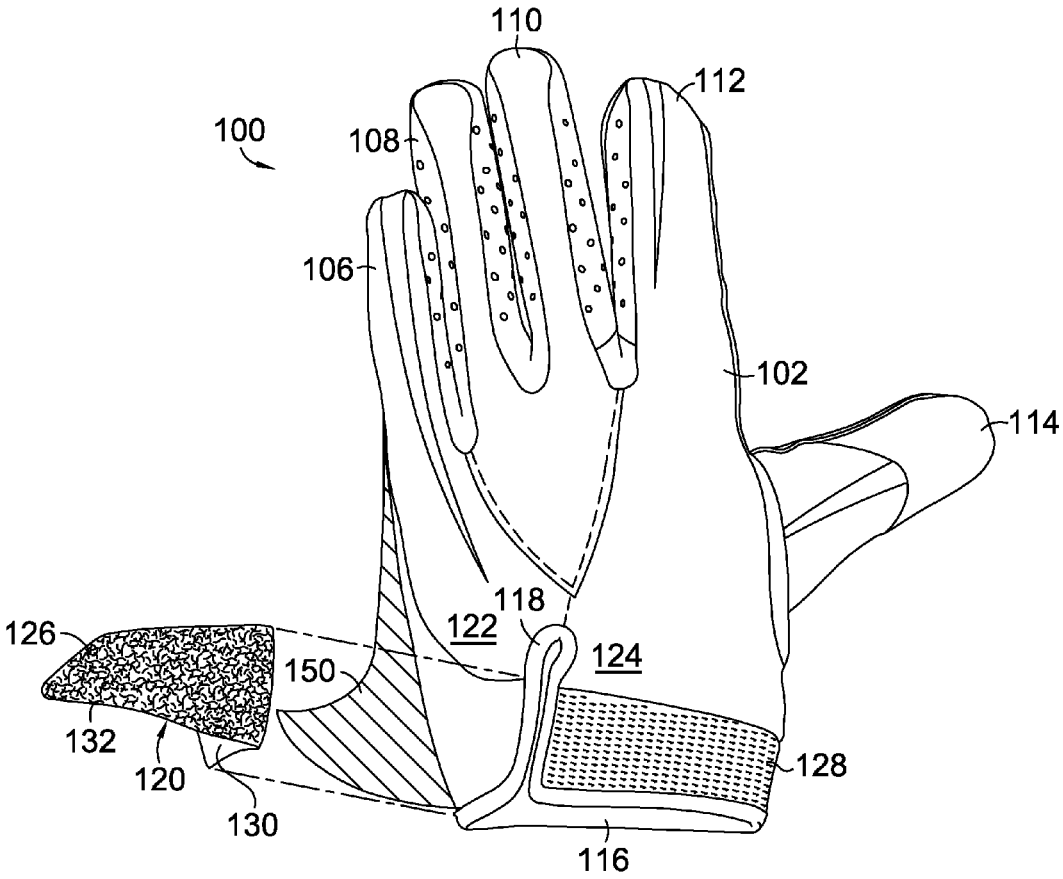
FIG. 9 is an exploded perspective view of an exemplary embodiment of an athletic glove with enhanced tensioning illustrating the back portion of the glove with the wrist strap unaffixed and the wrap-around palm portion disconnected from the keyhole and back portion.

The part of palm-side portion 104 that extends from the palm side of a user's hand around the edge of the user's hand to the back of the user's hand and to keyhole 118, as shown in FIG. 7, can be thought of as a wrap-around palm portion. FIGS. 8 and 9 further illustrate wrap-around palm portion 150 of glove 100. FIG. 8 shows glove 100 with base portion 130 of wrist strap exploded out to illustrate more clearly the characteristics of wrap-around palm portion 150. Wrap-around palm portion 150 connects palm-side portion 104 to back portion 102 and keyhole 118. Wrap-around palm portion 150 and palm-side portion 104 are one continuous piece of material in some embodiments. As shown in FIG. 8, wrap-around palm portion 150 flares out and curves until it meets keyhole 118. In other embodiments, the shape of wrap-around palm portion 150 has a different geometry. In one embodiment, the connection between wrap-around palm portion 150 and first side 122 is substantially straight rather than curved as is shown in FIG. 8.

FIG. 9 illustrates a similar view of glove 100 with wrap-around palm portion 150 of glove 100 peeled back to more clearly show the additional palm material of wrap-around palm portion 150. Wrap-around portion 150 is attached to first side 122 and keyhole 118 as described in previous figures, and is shown "peeled" for purely explanatory purposes. In some embodiments, wrap-around palm portion 150 of glove 100 extends approximately one to one-and-one-half inches beyond the edge of glove 100 when peeled back. The additional palm fabric of wrap-around palm portion 150 is not found in conventional athletic gloves, such as glove 10 shown in FIGS. 1 and 2.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

Having thus described the invention, what is claimed is:

1. An athletic glove capable of receiving a human hand, the athletic glove comprising:

a back portion;

a palm-side portion connected to the back portion to form four finger sheaths, a thumb sheath, and a glove opening capable of receiving a human hand, the glove opening located opposite the four finger sheaths and corresponding approximately to the wrist of a user when the glove is worn by the user with fingers of the user extending within the four finger sheaths and the thumb of the user extending within the thumb sheath;

a keyhole cutout along the glove opening, the location of the keyhole corresponding to the back of the user's hand; and a tension-adjusting wrist strap with a top edge facing the finger sheaths and a bottom edge at the glove opening capable of receiving a human hand, attached to the glove on a first side of the keyhole adjacent to the glove opening, extending across the keyhole to a second side of the keyhole, and detachably affixable to the second side of the keyhole adjacent to the glove opening, the wrist strap comprising:

a base portion attached to the glove on the first side adjacent to the keyhole, the base portion extending away from the keyhole along the glove opening to a location along the glove opening that corresponds to the palm side of the user's wrist, the width of the base portion decreasing as the distance between the top edge of the wrist strap corresponding to the base portion and the glove opening reduces, the bottom edge of the wrist strap corresponding to the base portion remaining oriented substantially linear and perpendicular to the four finger sheaths as the base portion extends away from the keyhole and the top edge of the wrist strap corresponding to the base portion being at a decreasing distance from the bottom edge along the length of the base portion as it extends away from the keyhole to form an angled base portion;

a tab portion extending from the base portion across the keyhole and detachably affixable to the glove on the second side along the glove opening such that when the tab portion of the wrist strap is detachably affixed, the tab portion lays across the keyhole, the width of the tab portion gradually decreasing with the bottom edge of the wrist strap corresponding to the tab portion remaining oriented substantially linear and perpendicular to the four finger sheaths as the tab portion extends away from the keyhole to form an angled tab portion and with the top edge of the wrist strap corresponding to the tab portion being at a decreasing distance from the bottom edge of the wrist strap corresponding to the tab portion as it extends away from the keyhole;

such that an apex aligned with the keyhole is formed at the top edge of the wrist strap where the base portion of the wrist strap ends and the tab portion of the wrist strap begins, with the bottom edge of the wrist strap remaining oriented substantially perpendicular to the four finger sheaths; and such that the wrist strap may be used to adjust the tension across the palm-side portion of the glove by adjusting where the tab portion is detachably affixed.

2. The athletic glove of claim 1, wherein the palm-side portion is made of a grip-enhancing material.

3. The athletic glove of claim 1, wherein the base portion and tab portion of the wrist strap form one continuous piece of material.

4. The athletic glove of claim 1, wherein the keyhole cutout extends between approximately one-half inch and two inches in from the glove opening.

5. The athletic glove of claim 1, wherein the keyhole cutout is nearer to the middle of the back of the user's hand than either side.

6. The athletic glove of claim 1, wherein the palm-side portion extends from the area corresponding to the palm of a user around the area corresponding to an edge of the user's hand to the area corresponding to the back of the user's hand and is attached to the base portion of the wrist strap.

7. The athletic glove of claim 6, wherein as the palm-side portion extends from the area corresponding to the palm of the user around the area corresponding to the edge of the user's hand to the area corresponding to the back of the user's hand, the palm-side portion flares out and extends to the keyhole on the first side of the keyhole.

8. The athletic glove of claim 7, wherein the base portion of the wrist strap is attached to the palm-side portion of the glove on the first side of the keyhole, the top edge of the wrist strap and a cross section of the user's wrist, forming an angle of between approximately 10 degrees and 80 degrees.

9. The athletic glove of claim 1, wherein the tab portion of the wrist strap is detachably affix able in a plurality of positions.

10. The athletic glove of claim 9, wherein the tab portion of the wrist strap is detachably affix able with hook-and-loop connectors.

11. The athletic glove of claim 9, wherein the tab portion of the wrist strap is detachably affix able with snaps.

12. An athletic glove capable of receiving a human hand, the athletic glove comprising:

a back portion;

a palm-side portion connected to the back portion to form four finger sheaths, a thumb sheath, and a glove opening capable of receiving a human hand, the glove opening located opposite the four finger sheaths and corresponding approximately to the wrist of a user when the glove is worn by the user with fingers of the user extending within the four finger sheaths and the thumb of the user extending within the thumb sheath;

a keyhole cutout along the glove opening, the location of the keyhole corresponding to the back of the user's hand;

a wrap-around palm portion that connects the palm-side portion to the back portion and keyhole, the wrap-around palm portion extending from the palm-side portion around the area corresponding to an edge of the user's hand to the area corresponding to the back of the user's hand adjacent to the keyhole on a first side of the keyhole, the wrap-around palm portion flaring out as it extends to the keyhole; and a tension-adjusting wrist strap with a top edge facing the finger sheaths and a bottom edge at the glove opening capable of receiving a human hand, attached to the glove on the first side of the keyhole adjacent to the glove opening, extending across the keyhole to a second side of the keyhole, and detachably affixable to the second side of the keyhole adjacent to the glove opening, the wrist strap comprising:

a base portion attached to the glove on the first side adjacent to the keyhole, the base portion extending away from the keyhole along the glove opening to a location along the glove opening that corresponds to the palm side of the user's wrist, the width of the base portion decreasing as the distance between the top edge of the wrist strap corresponding to the base portion and the glove opening reduces, the bottom edge of the wrist strap corresponding to the base portion remaining oriented substantially linear and perpendicular to the four finger sheaths as the base portion extends away from the keyhole and the top edge of the wrist strap corresponding to the base portion being at a decreasing distance from the bottom edge along the length of the base portion as it extends away from the keyhole to form an angled base portion;

a tab portion extending from the base portion across the keyhole, the width of the tab portion gradually decreasing with the bottom edge of the wrist strap corresponding to the tab portion remaining oriented substantially linear and perpendicular to the four finger sheaths as the tab portion extends away from the keyhole to form an angled tab portion and with the top edge of the wrist strap corresponding to the tab portion being at a decreasing distance from the bottom edge of the wrist strap corresponding to the tab portion as it extends away from the keyhole;

such that an apex aligned with the keyhole is formed at the top edge of the wrist strap where the base portion of the strap ends and the tab portion of the wrist strap begins, with the bottom edge of the wrist strap remaining oriented substantially perpendicular to the four finger sheaths; and the tab portion of the wrist strap being detachably affixable to the glove on the second side along the glove opening such that when the tab portion of the wrist strap is detachably affixed, the tab portion lays across the keyhole and such that the wrist strap may be used to adjust the tension across the palm-side portion of the glove by adjusting where the tab portion is detachably affixed.

13. The athletic glove of claim 12, wherein the palm-side portion is made of a grip-enhancing material.

14. The athletic glove of claim 12, wherein the base portion and tab portion of the wrist strap form one continuous piece of material.

15. The athletic glove of claim 12, wherein the keyhole cutout extends between approximately one-half inch and two inches in from the glove opening.

16. The athletic glove of claim 12, wherein the keyhole cutout is nearer to the middle of the back of the received hand than either side.

17. The athletic glove of claim 12, wherein the palm-side portion and the wrap-around palm portion are one continuous piece of material.

18. The athletic glove of claim 12, wherein the tab portion of the wrist strap is detachably affix able in a plurality of positions.

19. The athletic glove of claim 18, wherein the tab portion of the wrist strap is detachably affix able with hook-and-loop connectors.

* * * * *